US007207381B2

(12) United States Patent
Sharp

(10) Patent No.: US 7,207,381 B2
(45) Date of Patent: Apr. 24, 2007

(54) DOWNHOLE PUMP DRIVEN BY INJECTION WATER

(76) Inventor: Allan Sharp, 31 Newton Avenue, Abroath, Angus (GB) DD1 3LH ( * ) Notice: Subject to any disclaimer, the term of this patent is extended or adjusted under 35 U.S.C. 154(b) by 77 days.

(21) Appl. No.: 10/468,092

(22) PCT Filed: Feb. 5, 2002

(86) PCT No.: PCT/EP02/01214

§ 371 (c)(1),
(2), (4) Date: Feb. 13, 2004

(87) PCT Pub. No.: WO02/068794

PCT Pub. Date: Sep. 6, 2002

(65) Prior Publication Data

US 2004/0129427 A1 Jul. 8, 2004

(30) Foreign Application Priority Data

Feb. 14, 2001 (GB) ..... 0103576.5

(51) Int. Cl.
*E21B 43/38* (2006.01)

(52) U.S. Cl. ..... 166/54.1; 166/106

(58) Field of Classification Search ..... 166/369, 166/265, 54.1, 105, 106
See application file for complete search history.

(56) References Cited

U.S. PATENT DOCUMENTS

| | | | | |
|---|---|---|---|---|
| 3,882,946 | A * | 5/1975 | Ioannesian et al. | 175/107 |
| 6,019,583 | A | 2/2000 | Wood | 418/48 |
| 6,056,054 | A | 5/2000 | Brady et al. | 166/265 |
| 2001/0007283 | A1 * | 7/2001 | Johal et al. | 166/265 |
| 2003/0047309 | A1 * | 3/2003 | Thomas et al. | 166/265 |

FOREIGN PATENT DOCUMENTS

| | | |
|---|---|---|
| GB | 2 311 312 B | 3/1998 |
| GB | 2 324 108 A | 10/1998 |
| GB | 2 358 202 A | 7/2001 |

* cited by examiner

*Primary Examiner*—William P. Neuder
(74) *Attorney, Agent, or Firm*—John J. Penny, Jr.; Edwards Angell Palmer & Dodge LLP

(57) ABSTRACT

A method and apparatus for improving the performance of production-injection wells whereby a pump (35), driven by a hydraulic turbine (32) sharing the same central shaft (33, 34), is run and set in an oil-producing well. The oil enters the annulus of the well from the production zone and is induced into the pump to be forced to the wellhead; the injection water is forced down the wellbore to drive the turbine whereafter the injection water exhausts through the pump to be injected into the underlying aquifer thereby providing additional pressure support to the producing zone.

10 Claims, 3 Drawing Sheets

DOWNHOLE PUMP DRIVEN BY INJECTION WATER

Applicant claims priority to GB 103576.5 filed on Feb. 14, 2001 and PCT/EP02/01214 filed on Feb. 5, 2002, which are hereby incorporated by reference in their entirety.

The present invention relates to a pump, and particularly one to be installed downhole for recovery of hydrocarbon fluids from drilled wells, and for the injection of fluids such as water into such wells in order to stimulate the production of fluid hydrocarbons therefrom.

Oilfield reservoirs generally consist of a layer of hydrocarbon fluids such as oil which lies on top of a denser layer of water called the aquifer. In low pressure wells or wells which have been produced for a number of years and which no longer have sufficient natural pressure to allow unaided flow of hydrocarbons from the reservoir payzone to surface, it is conventionally known to inject water into the underlying aquifer in order to maintain or increase the pressure in the reservoir and to enhance the flow of hydrocarbon fluids into a wellbore.

According to the present invention there is provided a pump for drawing a first fluid from a first end of the pump to a second end, the pump being powered by the flow of a drive fluid from the second end to the first, wherein the first fluid and the drive fluid flow through separate conduits, one of the conduits being located within the other.

The said one conduit is preferably entirely contained within the said other conduit.

In the pump of the invention, the drive fluid preferably goes through a first conduit, and the produced first fluid goes through the other in the opposite direction. The pump of the invention therefore avoids crossover of drive and produced fluids in the body of the pump. Certain embodiments can also minimise the complexity of downhole completion.

In a preferred embodiment of the invention, the drive fluid passes down an inner conduit, and the produced fluid passes up the annulus between the inner conduit and an outer tube. The blades of a turbine are preferably disposed in the path of the inner conduit and the turbine preferably provides power to a shaft which powers a pump driving the produced fluids up through the outer annulus. However, the drive fluid could equally pass through the outer annulus, and the production fluid could pass through the inner conduit. The pump in the outer annulus can be a centrifugal pump.

An embodiment of the invention will now be described by way of example and with reference to the accompanying drawings in which.

Figure 1:
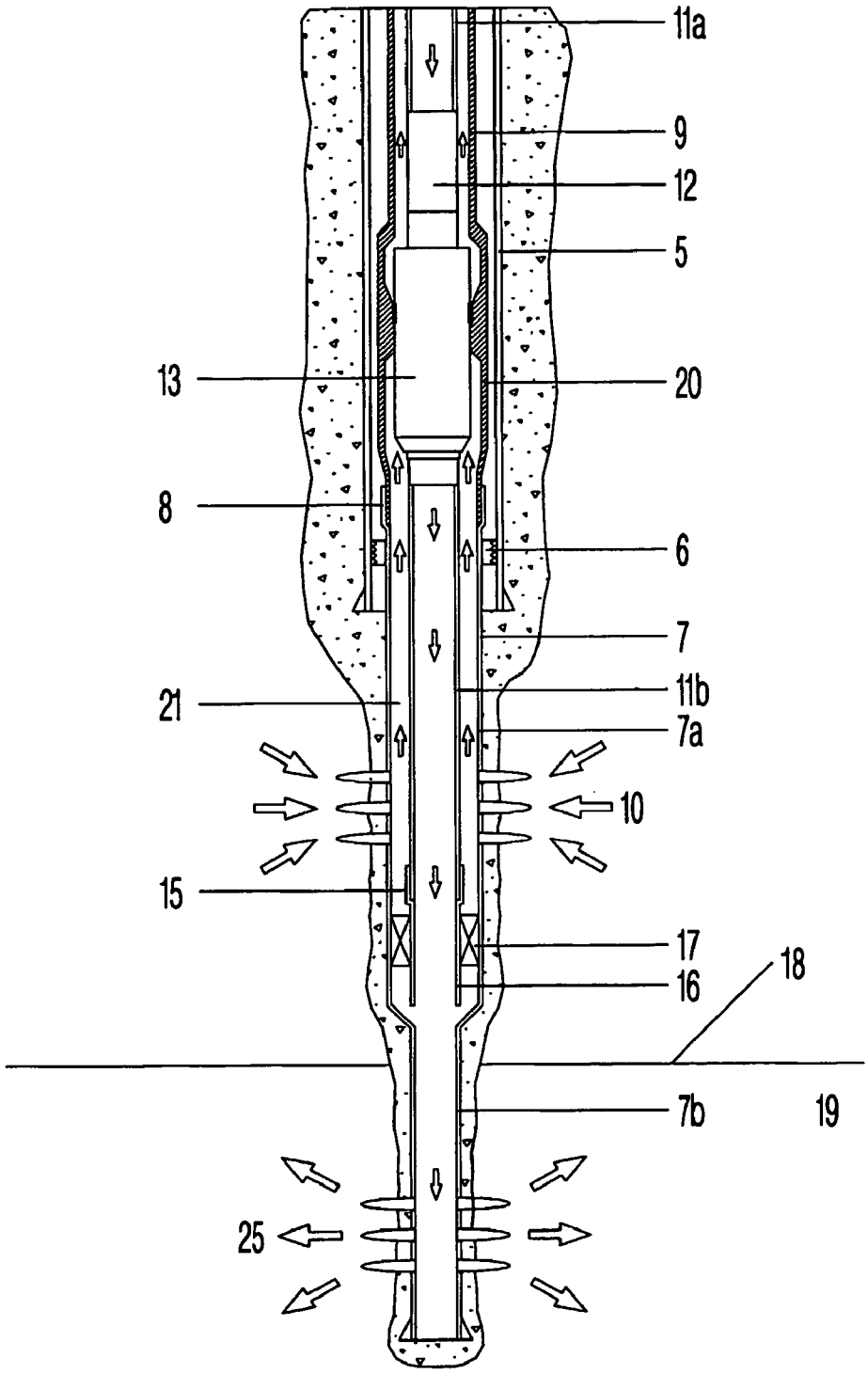
FIG. 1 shows a schematic diagram of a pump of the present invention.

Referring now to the drawings, the well schematic shown in FIG. 1 comprises a borehole lined with casing 5 which is cemented in place in the borehole in a conventional manner. A tapered liner 7, of which 7*a* and 7*b* are the upper and lower sections, is hung off from casing 5 by a liner hanger 6, is cemented in situ and perforated at 10 in a reservoir payzone allowing ingress of hydrocarbon fluids, and is additionally perforated at its furthest extremity 25 to allow injection of water or other liqueous fluids into an aquifer 19. The liner 7 terminates at its upper end in a polished bore receptacle 8, in which is received the lower end of a tieback tubing string 9 which includes a dedicated sealing/locking element 20, known in the industry as a nipple. The liner 7, nipple 20 and tieback tubing 9 provide an outer string in which is disposed tubing 11*a*, a turbine sub 12, a pump body 13 located in the nipple 20 and injection tubing 11*b* which is received in the polished-bore receptacle 15 of a packer shoe 16 sealed by packer 17 to the cemented liner at the lower end of section 7*a* between the perforations 10 and 25. Use of PBRs facilitates installation and retrieval of injection tubing for maintenance etc.

The bore of the turbine sub 12, pump body 13, the injection string of 11*a* and 11*b*, packer shoe 16 and section 7*b* of liner 7 provide an inner injection conduit located within the outer annular conduit. The outer wall of the outer flow conduit comprises the upper section 7*a* of liner 7, the outer wall of the pump body 13 sealed against nipple 20 and tieback tubing 9. The inner injection string is located wholly within the bore of the outer string, and is provided for the injection of aqueous fluid such as water to the perforations 12 located in the aquifer 19 below the oil/water interface 18 and horizontally distant from the production perforations 10 so as to reduce the propensity to coning. The outlet of the inner injection string is located below the packers 17 thus preventing leakage of water from the injection string back up the annulus.

The outer wall of the annular conduit comprising the cemented liner 7 and tieback tubing 9 including nipple 20 directs produced fluids entering the annulus 21 through perforations 10 up said annulus 21, through the pump body 13 and thence to surface. Injection of water through the inner injection string and lower perforations 25 below the oil water interface 18 maintains the pressure of hydrocarbon fluids entering the outer recovery string through upper perforations 10 where the reservoir and aquifer are in contact, and maximises recovery of produced fluids from the outer annulus.

Figure 2:
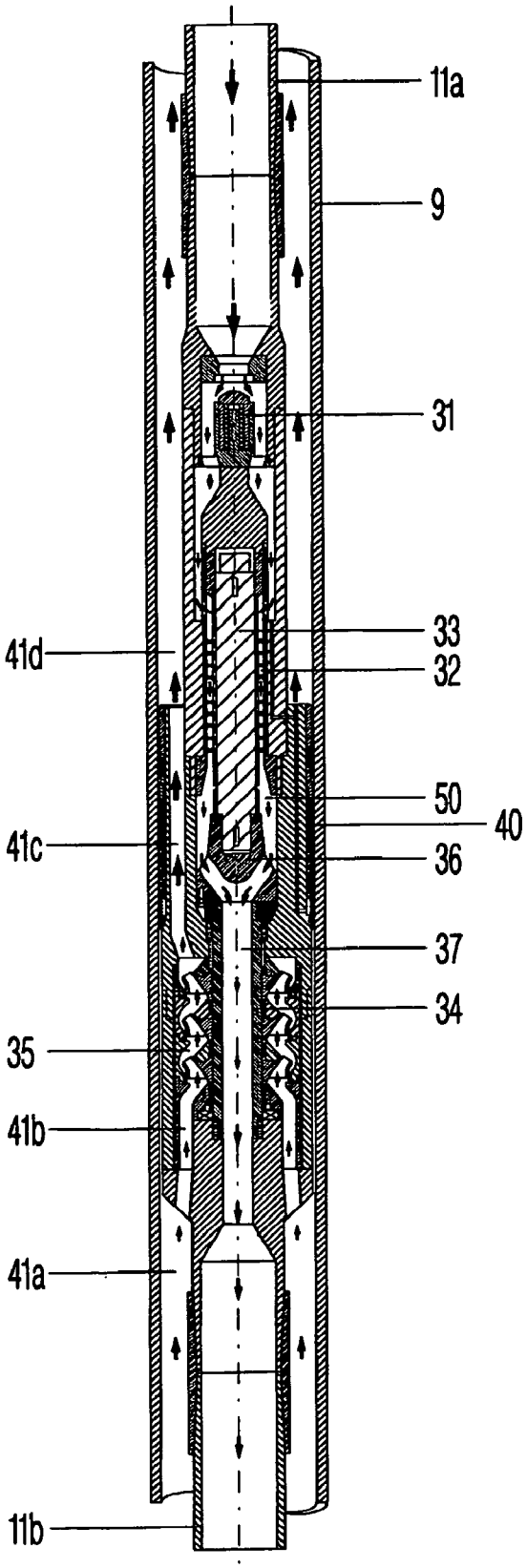
FIG. 2 shows a sectional view of a pump of another embodiment.

In the embodiment shown in FIG. 2, the bore of a tieback tubing string 9 houses a single inner string of tubulars 11*a* and 11*b* for injection of fluids and the annulus is provided between the inner string and the tieback tubing string 9. It is noted that there is no nipple in the tieback tubing string 9.

Tubing 11*a* is attached to the pump assembly in which is established a check valve sub-assembly 31. Opening of the check valve 31 allows flow of injected fluid through to a turbine assembly in which the flow of fluid is directed into the path of a number of turbine blade stages 32. Flow of fluid across the blades 32 causes rotation of the solid shaft 33, which drives a pump shaft 34 on which are mounted impeller stages 35. The respective shafts are mechanically connected by flow coupling 36, said flow coupling also providing passage for fluids leaving the turbine stage through to the pump shaft 34 which is hollow. The flow coupling is an important preferred feature of the invention as it can simultaneously entrain the pump shaft 34 from the turbine shaft 33, and ensures continuity of flow from the turbine exhaust chamber 50 through the bore 37 of pump shaft 34. The flow holes through the flow coupling would preferably be shaped in the manner of an impeller. Fluids leaving the turbine blades 32 are directed into the bore 37 of the pump shaft 34, said bore being in flow connection with the lower tubing string 11*b* leading to a lower injection point into the aquifer(see FIG. 1).

The tieback string 9 is preferably landed in the Xmas tree by a hanger at its upper extremity, and is set in the polished bore receptacle of a tapered liner at its lower extremity. A practical alternative to the polished bore receptacle is use of a packer. It is to the bore of string 9 that the pump assembly preferably seals. The method of FIG. 1 uses an external seal, typically in the form of chevron packing, set in a dedicated receptacle of a nipple type readily available to the industry. The preferred embodiment of FIG. 2 is of a pressure-activated external packer and slip system made integral with, or attached to, the pump assembly. The pump assembly is shown locked and sealed to the tieback string 9 by a slips/seal packer. The pump provides an annular flow path for produced fluids in complete isolation from the injection fluids. Produced fluids passing up the production annulus 41*a* enter the pump at 41*b*, are directed into the pump impellers 35 and flow thence to surface through pump exit 41*c* and upper annulus 41*d*.

The slips/seal packer assembly 40 is a standard item in the industry and may be set mechanically or hydraulically. The advantage in providing a packer 40 is that the pump can be set at any desired depth within in the tieback tubing string 9. The embodiment of FIG. 2 allows the drive fluid pressure to be used to set the packer 40 although 'hot lines'—small bore tubing—may be run to the packer from surface to provide setting and unsetting pressures.

Figure 3:
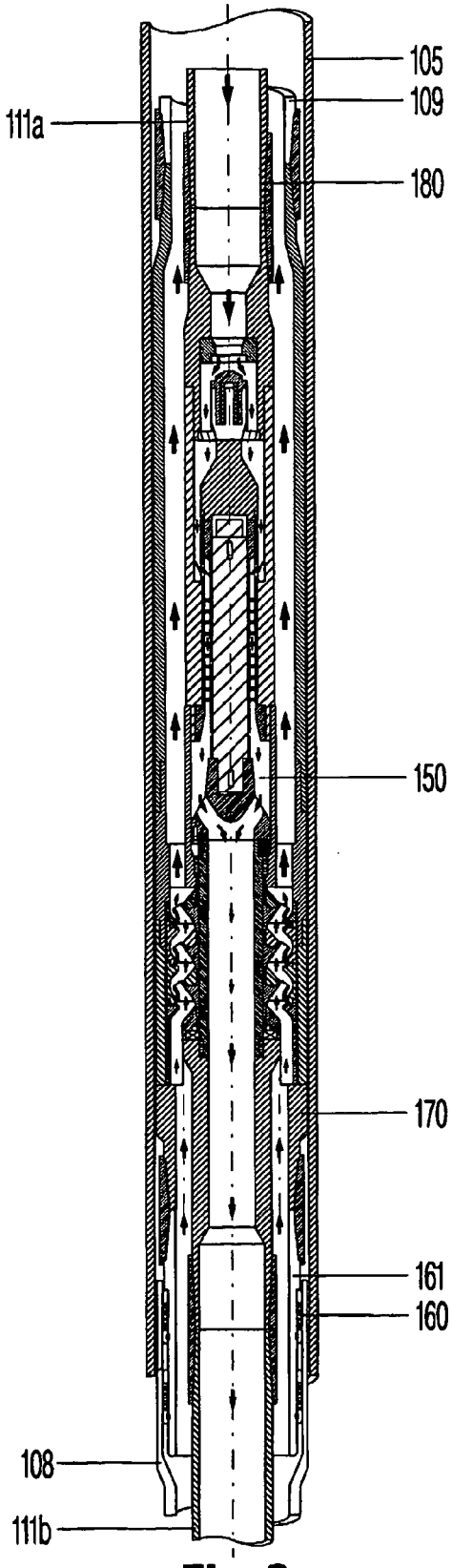
FIG. 3 shows a sectional view of a third embodiment of a pump according to the invention.

The modified embodiment of the invention as shown in FIG. 3 has many similar components and will be referred to for ease of reference using the same numbering system but with 100 added where required by context. Inside the body of the pump, the mechanical components function in essentially the same manner as those featured in FIG. 2 and shall only be described by exception. The principal differences are the configurations of the tubular and sealing elements. The size of the pump is limited by the internal diameter of the outer tubular within which the pump assembly and its associated tubulars and seals must be run and set. A pump assembly attached at its upper end to a tieback tubing string 109 is installed within a cemented casing string 105, the tieback tubing string being hung at the wellhead. The lower end of the pump assembly has chevron seal elements 160 carried on a spacer string 161, the length of the spacer string being determined-by operational requirements. For brevity, spacer string 161 is shown as a single item. The chevron seals set the polished-bore receptacle 108 which is sited at the top of the liner—not shown but corresponds to item 7 of FIG. 1. An alternative method of achieving the lower seal for the pump is to use a packer to replace the PBR. Tubular 111*b*, which is attached to the inner connection of lower body 170 of the pump, extends to an inner PBR—not shown but corresponds to item 15 of FIG. 1. After the pump assembly has been installed in the well, tubing 111*a* is run from the wellhead and attached the pump assembly's upper, inner connection by a lock/seal system of which many are available within the industry. It is seen on FIG. 3 that the flow system is essentially the same as that of FIGS. 1 and 2 but the size of the pump, where the same tubular program is used on all embodiments, is significantly increased owing to the limiting size being that of the casing 5 or 105 as referred to in FIGS. 1 and 3 respectively.

From this present embodiment it will be evident that modifications could be made to the basic system which enhance its installation and operation under various circumstances. Due to the flow coupling having a possible castellated mating form to the pump shaft 34 then the turbine unit could be separately installable/retrievable/replaceable by wireline or coiled tubing to suit the pump duty as downhole conditions vary with time.

Tubular goods sizes for drilling and completion of oil wells vary for different geographical locations and it should be noted that any sizes shown or cited herein are typically used in the North Sea and should not be construed in any limiting sense.

The assemblies of FIGS. 1 to 3 can be located at any desired depth in the well within casing string 5 which determines the maximum pump diameter. These embodiments provide an outer annulus for recovery of produced fluids and an inner bore for injection of a drive fluid to power the turbines and also for injection of fluid into the aquifer to increase recovery of produced fluids from the payzone of a formation. The drive fluid exhausts through the pump into a targeted injection zone within the aquifer.

It is also possible that very high pressure fluids from a deep-set abnormally pressured reservoir would provide the drive fluid to a turbine thus providing power to a pump to drive a pump for a lower pressure reservoir sited some distance above the former. This system would act as a pressure exchanger with both fluids being produced to surface.

Seals, although depicted and described as chevron types, can be of any desired type typically employed in the industry.

It should be noted that for clarity no details of shaft bearings have been shown in the drawings. However, pump shaft design and bearings therefor are well established and known to those in the art.

It is an especially preferred embodiment of the invention to provide a seal system such as a packer on a portion of the inner string so as to facilitate the sealing of the inner string or a chosen location within the outer string.

In certain cases, the origin of the produced fluids may be multilateral branches drilled through and out of the main well bore rather than perforations in the tie back tubing.

It is anticipated that for fractured or segmented reservoirs and aquifers, the injected and produced fluids would not necessarily enter into or originate from the aquifer and reservoir of a given oil-water contact. Geological factors could dictate that the injection fluid would preferably target the aquifer beneath a neighbouring reservoir separated from that of the well by an isolating fracture.

The invention claimed is:

1. An apparatus to improve the performance of combined production and injection wells which utilize a hydraulic pump assembly to increase the production rate of hydrocarbons from the well and to ensure passage of the injection water directly through the pump unit on exhausting from the turbine en route to the injection zone, said well including a casing, said apparatus comprising;

an inner tubing string running from a tubing hanger set in a Christmas tree at the wellhead to a downhole liner;

an outer tubing string running from a tubing hanger set in the Christmas tree at the wellhead to the downhole liner;

a pump assembly provided by threaded connections as part of the inner or outer tubing string as appropriate.

2. The apparatus of claim 1 wherein the inner tubing string which runs from a tubing hanger set in the christmas tree at the wellhead to the lower portion of which tubing string is attached a packer to be set within the downhole liner at a position below the production flow entry point(s) to the well, and of which tubing string the pump assembly is an element set at a depth appropriate to reservoir performance characteristics thus permitting further definition of said inner tubing string as comprising upper and lower strings related to the position therein of the pump assembly.

3. The apparatus of claim 1 wherein the pump assembly is provided as part of the outer tubing string.

4. The apparatus of claim 3 wherein a lower inner tubing string runs from the pump assembly to the injection packer.

5. The apparatus of claim 3 wherein an upper inner tubing string is a separate item run from the wellhead to the pump assembly subsequent to the installation downhole of the outer tubing string.

6. An apparatus to improve the performance of combined production and injection wells which utilize a hydraulic pump assembly to increase the production rate of hydrocarbons from the well and to ensure passage of the injection water directly through the pump unit on exhausting from the turbine en route to the injection zone, said well including a casing, said apparatus comprising;

an inner tubing string running from a tubing hanger set in a Christmas tree at the wellhead to a downhole liner;

an outer tubing string running from a tubing hanger set in the Christmas tree at the wellhead to the downhole liner;

a pump assembly provided by threaded connections as part of the inner or outer tubing string as appropriate, wherein the pump assembly is characterized, in combination, by:

a hydraulic rotary turbine mounted on and assembled to a solid shaft;

a hydraulic rotary pump of which the constituent impeller stages are mounted on and assembled to a hollow shaft;

a flow coupling linking the solid shaft of the turbine to the hollow shaft of the pump;

a packoff and slips module for use where the pump is provided as part of the inner tubing string.

7. The apparatus of claim 6 wherein the flow coupling which provides a mechanical link from the solid shaft of the turbine unit to the hollow shaft of the pump unit and further permits passage of the fluid exhausting from the turbine unit through to said hollow shaft of the pump unit is characterized by: passages drilled, as-cast, or formed through its body, said passages coinciding with the annular exit for fluids leaving the turbine stage on the outer side, and the entrance to the bore of the hollow shaft on the inner side and; provision of means of mechanical connection by appropriate bolting, clamping, castellated entrainment, or any combination thereof, to both the solid shaft of the turbine stage and the hollow shaft of the pump stage.

8. The apparatus of claim 6 wherein the hollow shaft to which the impeller elements of the pump are fixed provides passage of the injection fluid to the attached injection tubing, also known as the inner string.

9. The apparatus of claim 6 wherein the packoff and slips module of the pump assembly seals and locks the pump assembly against the bore of the outer tubing string, said module being integral with or attached to the pump assembly and being operated mechanically or hydraulically.

10. An apparatus to improve the performance of combined production and injection wells which utilize a hydraulic pump assembly to increase the production rate of hydrocarbons from the well and to ensure passage of the injection water directly through the pump unit on exhausting from the turbine en route to the injection zone, said well including a casing, said apparatus comprising;

an inner tubing string running from a tubing hanger set in a Christmas tree at the wellhead to a downhole liner;

an outer tubing string running from a tubing hanger set in the Christmas tree at the wellhead to the downhole liner;

a pump assembly provided by threaded connections as part of the inner or outer tubing string as appropriate, wherein the outer tubing string runs from a tubing hanger set in a christmas tree at the wellhead to the downhole liner, said tubing string providing the outer wall of a flow annulus for produced fluids, and the wall against which a seal and slips module of the pump assembly shall seal and lock.

* * * * *